US006827610B2

(12) United States Patent
Lin

(10) Patent No.: US 6,827,610 B2
(45) Date of Patent: Dec. 7, 2004

(54) ELECTRICAL CONNECTOR

(75) Inventor: Tung-Chang Lin, Taipei Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/744,486

(22) Filed: Dec. 23, 2003

(65) Prior Publication Data

US 2004/0157491 A1 Aug. 12, 2004

(30) Foreign Application Priority Data

Dec. 24, 2002 (TW) ..... 91220981 U

(51) Int. Cl.[7] ..... H01R 13/648
(52) U.S. Cl. ..... 439/607; 439/566
(58) Field of Search ..... 439/607–610, 439/79, 566, 567, 572

(56) References Cited

U.S. PATENT DOCUMENTS 6,129,562 A * 10/2000 Hong ..... 439/79
6,319,062 B1 * 11/2001 Ma et al. ..... 439/607
6,398,587 B1 * 6/2002 Chen et al. ..... 439/607
6,595,801 B1 * 7/2003 Leonard et al. ..... 439/607
6,764,338 B2 * 7/2004 Fang ..... 439/607

* cited by examiner

*Primary Examiner*—Hien Vu
(74) *Attorney, Agent, or Firm*—Robert J. Zeitler

(57) ABSTRACT

An electrical connector includes an insulating housing, a plurality of electrical terminals, an inner shield housing and an outer shield housing, the outer shielding is designed in a two-piece type and has a first shield member and a second shield member. The first shield member has a first resilient tab forwardly extending therefrom and the second shield member has a wing tab disposed therein, so as to the first resilient tab and the wing tab will not interfere with each other for the wing tab going with the outer shield housing, the electrical connector can be disposed in a recess on an edge of the PCB such that the electrical connector includes a portion thereof that is located above an outer surface of the PCB and another portion that is located below the outer surface of the PCB.

11 Claims, 7 Drawing Sheets

ELECTRICAL CONNECTOR

FIELD OF THE INVENTION

The present invention relates to an electrical connector capable of being mounted on a printed circuit board ("PCB") or other substrate, and in particular, to an electrical connector capable of being mounted in a recess on an edge of a PCB in such a manner that a portion of the connector is located above an outer surface of the PCB and another portion of the connector is located below an outer surface of the PCB.

BACKGROUND OF THE INVENTION

Referring to FIG. 1 and FIG. 2, from which a conventional electrical connector adopted for a high speed transferring and relating to the IEEE 1394b standard mounted on an outer surface of a PCB 100, and capable of being mated with a mating connector. The electrical connector includes an insulating housing 60, a plurality of electrical terminals 70 disposed in the insulating housing 60, an inner shield housing 80 covering the insulating housing 60, and an outer shield housing 90 wrapping the insulating housing 60.

The insulating housing 60 includes a base 61 and a pair mating plates arranged parallel and extending forwardly from the base 61, the pair mating plates respectively define a first mating plate 62 and a second mating plate 63, and the pair mating plates each has a plurality of slots 64 extending backwardly and penetrating through the base 61. The electrical terminals 70 respectively and correspondingly receive in the slots 64, and each has a contact portion 71 electrically engaging with the mating connector and a tail portion 72 exposing out of the insulating housing 60 and electrically connecting the PCB 100.

The inner shield housing 80 covers a peripheral of each of the pair of mating plates and has a first cavity 81 formed therein. The outer shield housing 90 wraps a peripheral of the base 61 and extends forwardly, and the outer shield housing 90 has a second cavity 91 formed between the inner shield housing 80 and the outer shield housing 90. The first cavity 81 and the second cavity 91 are applied with partial insertion of the mating connector for the mating connector electrically connecting the PCB 100.

For the reason that the electrical connector firmly connects the mating connector, there are resilient members 82, 92 respectively arranged on the inner shield housing 80 and the outer shield housing 90 for the resilient members 82, 92 clamping the mating connector. However, the resilient members 92 are disposed on two sidewalls of the outer shield housing 90 and occupy space where wing tabs are needed when it is desired to mount the connector such that the connector is mounted within a recess at the edge of the PCB.

OBJECT AND SUMMARY OF THE INVENTION

One object of the present invention is to overcome the problems of the prior art noted above.

In particular, the object of the invention is therefore to specify an electrical connector has an outer shielding designed in a two-piece type and having a first shield member and a second shield member. The first shield member has a first resilient tab forwardly extending therefrom and the second shield member has a wing tab disposed therein, such that the first resilient tab and the wing tab will not interfere with each other, and so that the connector can be mounted in a recess on an edge of a PCB in such a manner that a portion of the connector is located above an outer surface of the PCB and another portion of the connector is located below the outer surface of the PCB. This results in a reduce height that the connector extends above the outer surface of the PCB.

According to the invention, this object is achieved by a electrical connector which includes an insulating housing having a plurality of slots, a plurality of electrical terminals respectively receiving in the slots, an inner shield housing including a first cavity formed therein and covering the insulating housing, and an outer shield housing covering the insulating housing. Each of the electrical terminals includes a contact portion electrically engaging with the mating connector and a tail portion exposing out of the insulating housing and electrically connecting the PCB. The outer shield housing has a first shield member and a second shield member combining with the first shield member integrally, which both respectively cover the insulating housing. A second cavity is formed between the first shield member and the second shield member. The first shield member has a first resilient tab forwardly extending from and connecting with each of two sidewalls thereof, the second shield member has a recess formed on each of two sidewalls thereof and relating to the first resilient tab for containing the first resilient tab into the recess, and a wing tab folded from a rim around the recess, thereby allowing the connector to be mounted within a recess at an edge of the PCB. Additionally, the wing tab may be firmly connecting to the PCB.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE DISCLOSED EMBODIMENTS

Figure 1:
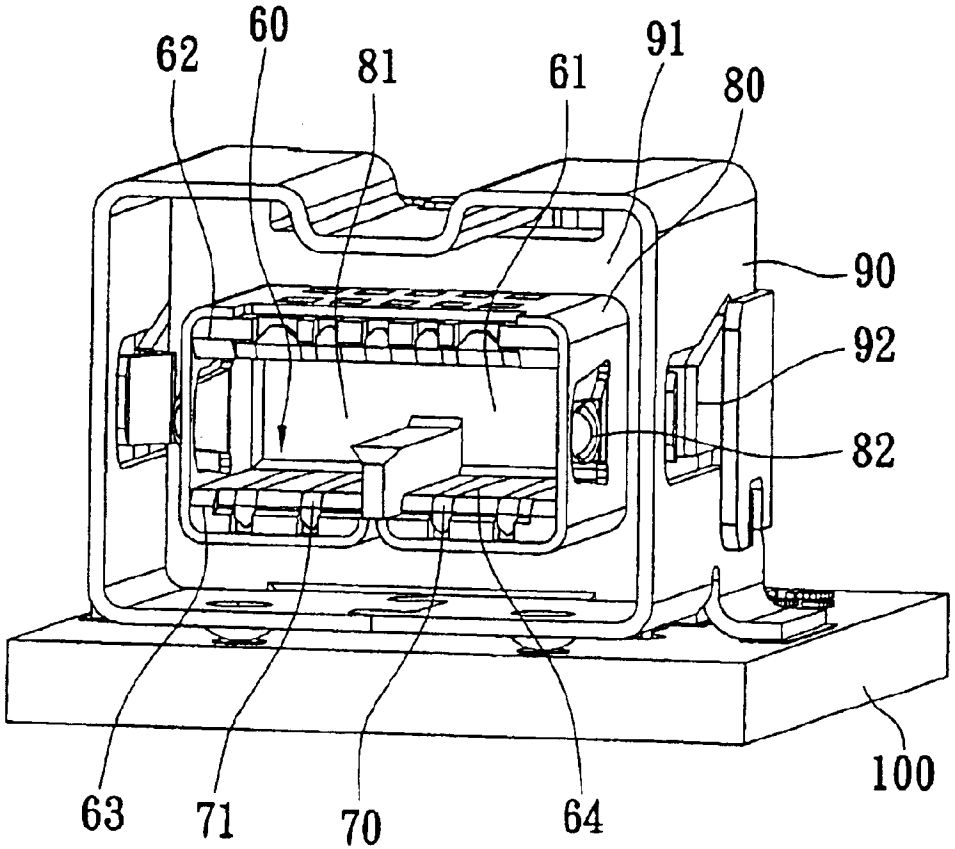
FIG. 1 PRIOR ART
FIG. 1 is a perspective view of a conventional electrical connector.
Figure 2:
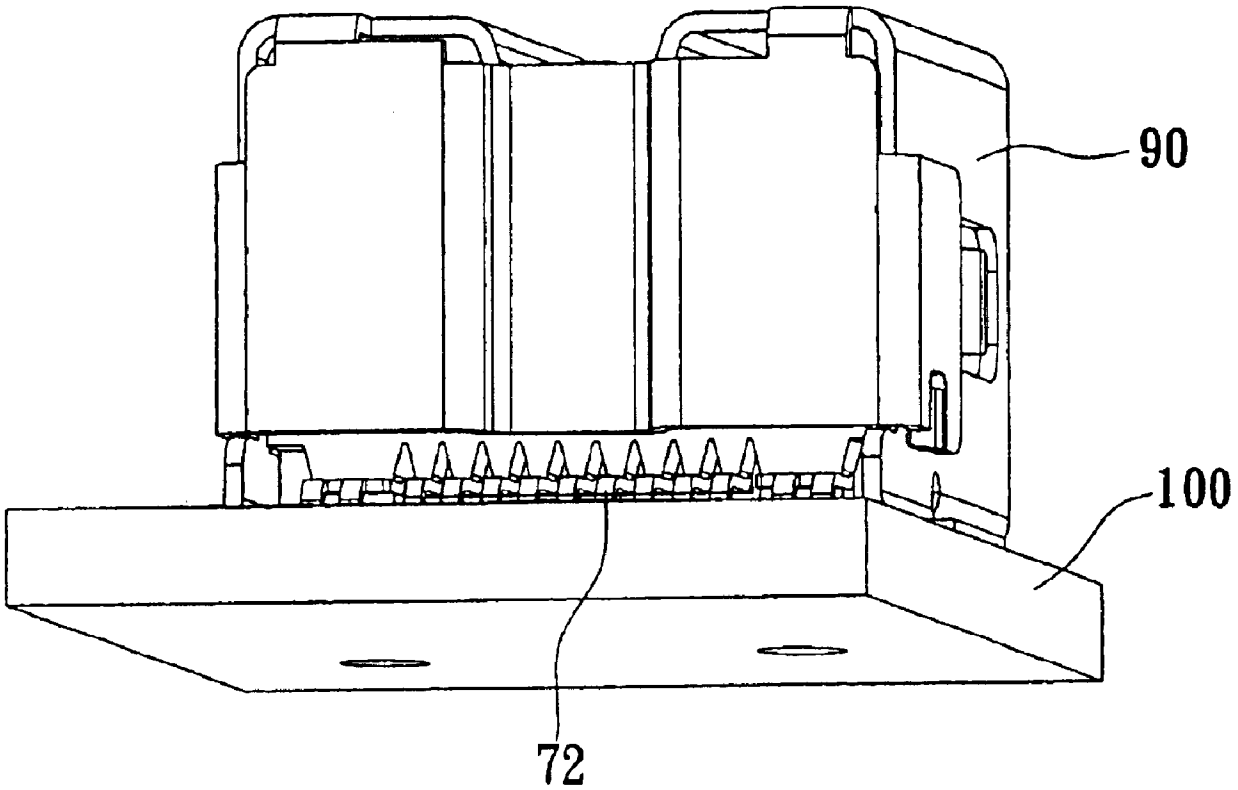
FIG. 2 PRIOR ART
FIG. 2 is a perspective view of the conventional electrical connector according to another angle.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 3:
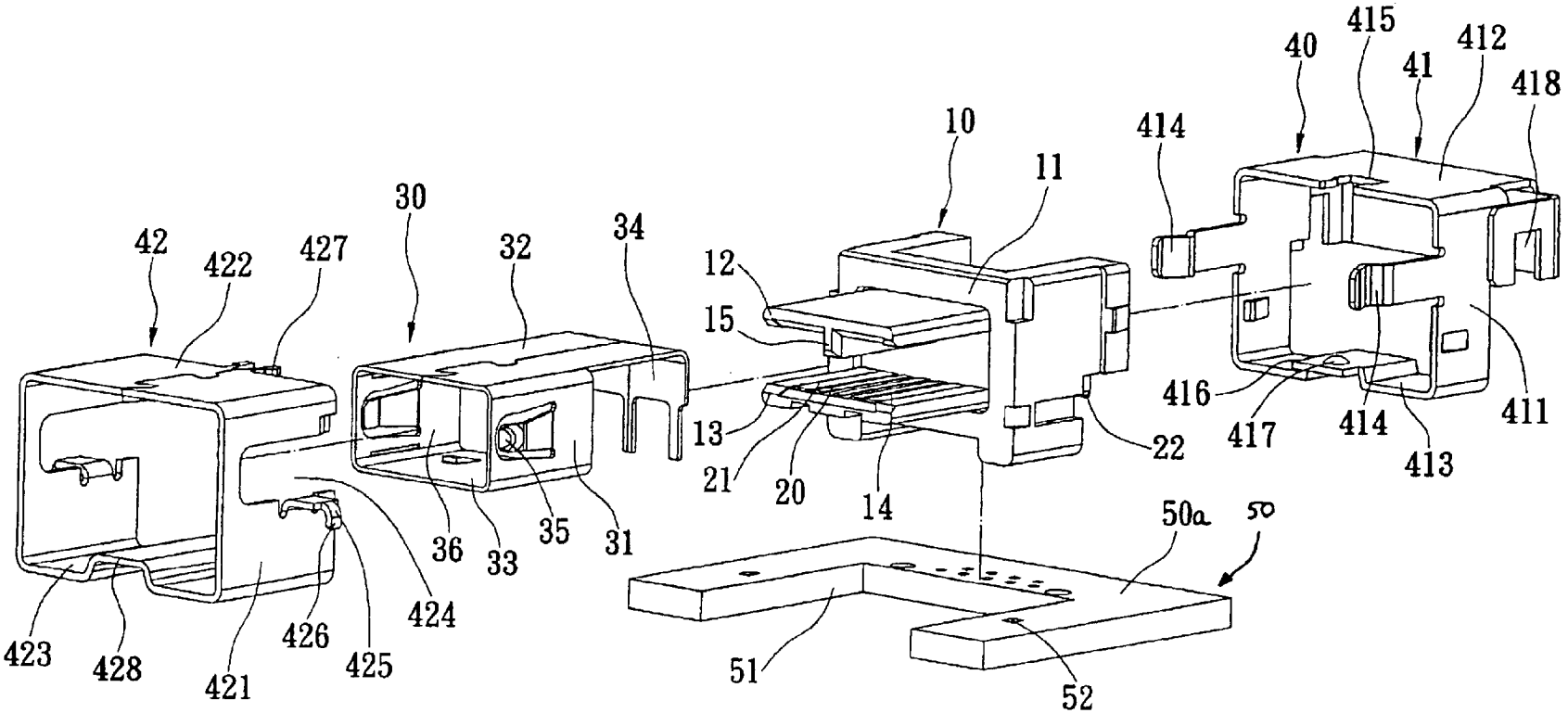
FIG. 3 is a decomposition view of the present invention electrical connector.
Figure 4:
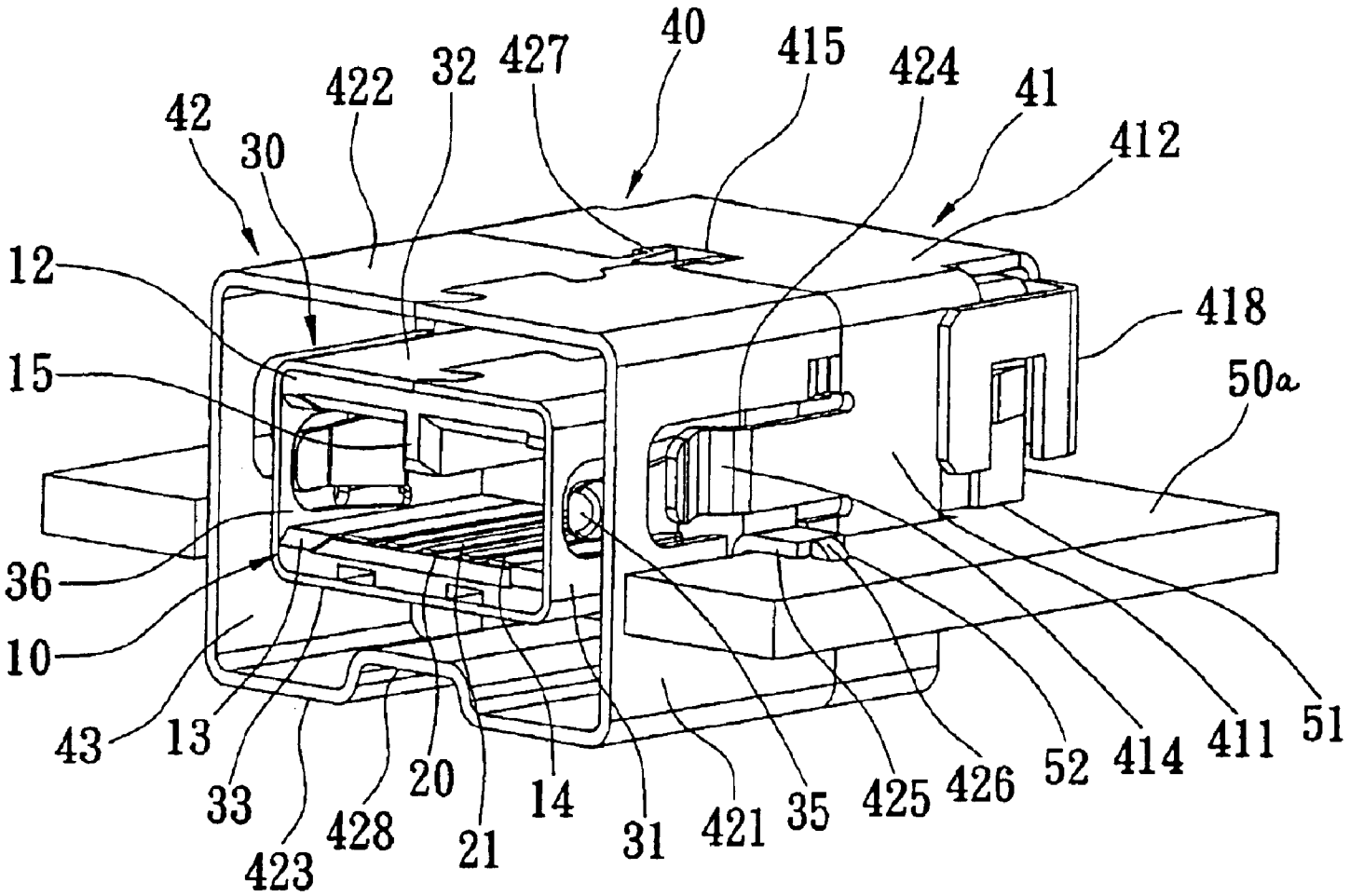
FIG. 4 is a perspective view of the present invention electrical connector.

With respect to FIG. 3 and FIG. 4, the present invention provides an electrical connector capable of being mounted to a PCB 50 for engaging with a mating connector. The electrical connector includes an insulating housing 10, a plurality of electrical terminals 20, an inner shield housing 30 and an outer shield housing 40. Wherein the insulating housing 10 is made of an insulating plastic material and has a base 11, a first mating plate 12 and a second mating plate 13 parallel arranged and both extending forwardly from the base 11, the first mating plate 12 and a second mating plate 13 each has a plurality of slots 14 formed and distributed thereon. The slots 14 respectively form on a bottom surface of the first mating plate 12 and a top surface of the second mating plate 13, and the slots 14 extends backwardly and penetrates through the base 11. The first mating plate 12 further has a projecting strip 15 disposed on a middle thereof and exposing forwardly to the second mating plate 13.

The electrical terminals 20 are made of metallic material with excellent conductivity and respectively receiving in the slots 14. Each of the electrical terminals 20 includes a contact portion 21 electrically engaging with the mating connector and a tail portion 22 extending from the insulating housing and electrically connecting the PCB 50.

The inner shield housing 30 is made of metallic material with excellent shielding function. The inner shield housing 30 includes two opposing sidewalls 31 arranged straight vertically and parallel, and a top wall 32 and a bottom wall 33 both disposed horizontally and connecting the two opposing sidewalls 31. The top wall 32 defines a rear wall 34 downwardly extending and connecting a rear end thereof, the two opposing sidewalls 31 each has a second resilient tabs 35 disposed thereon. The inner shield housing 30 covers a peripheral of each of the first mating plate 12 and the second mating plate 13, and includes a first cavity 36 formed therein.

Figure 5:
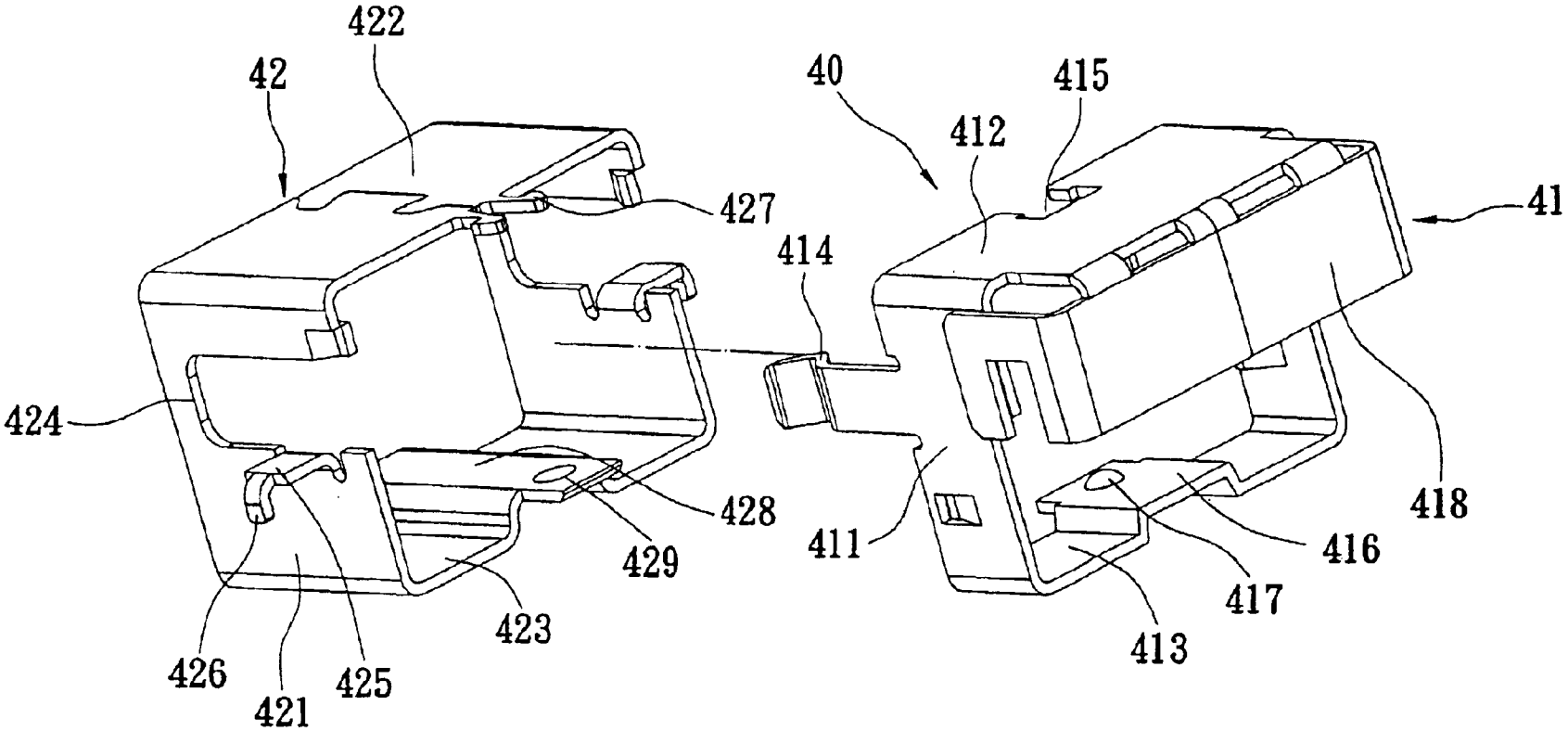
FIG. 5 is a decomposition view of an outer shield housing according to the present invention electrical connector.
Figure 6:
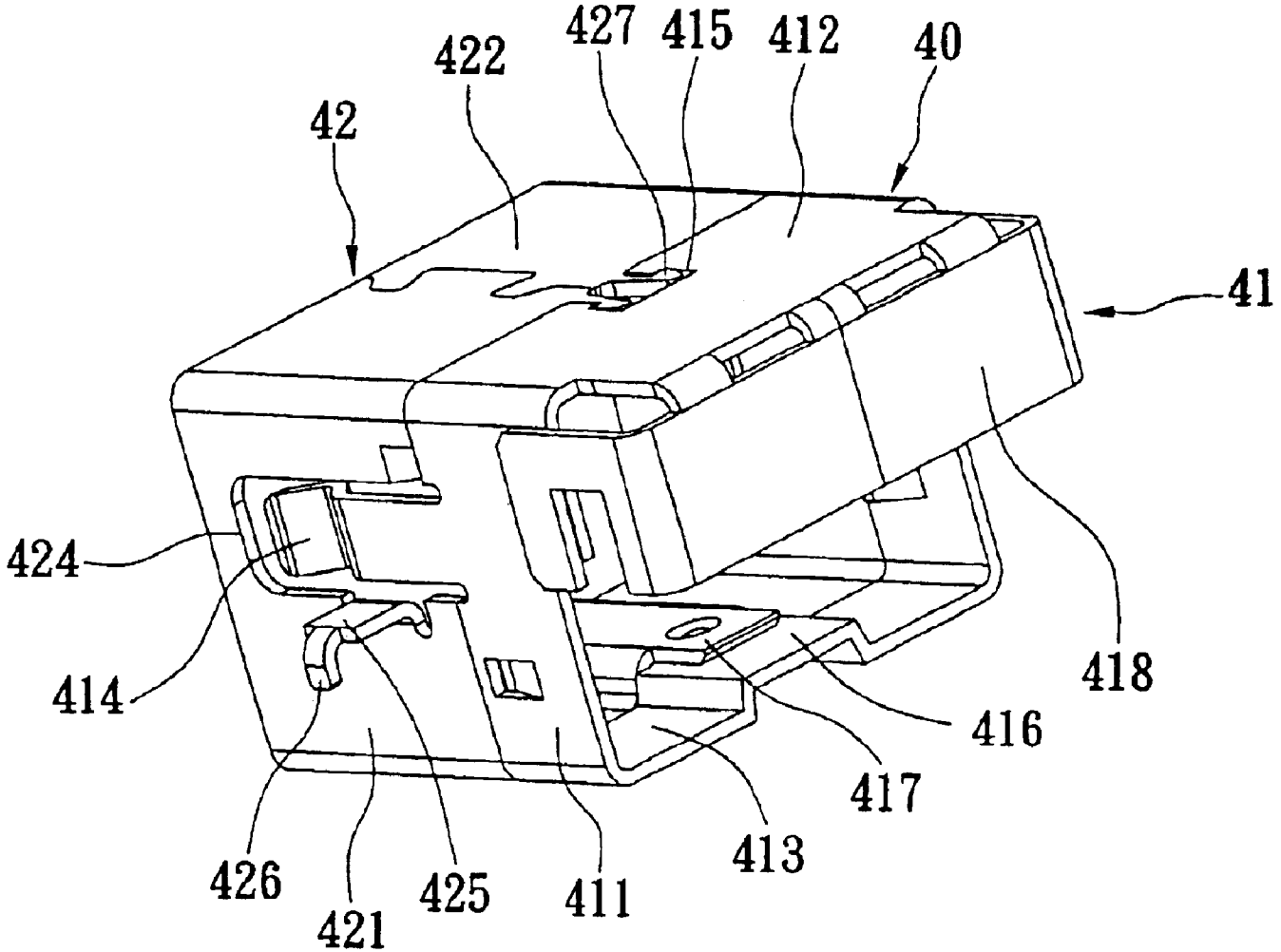
FIG. 6 is a perspective view of the outer shield housing according to the present invention electrical connector.

The outer shield housing 40 is made of metallic material with excellent shielding function. The outer shield housing 40 includes a first shield member 41 and a second shield member 42 combining with the first shield member integrally, (shown in FIG. 5 and FIG. 6), wherein the first shield member 41 covers the base 11 and includes two opposing sidewalls 411 arranged straight vertically and parallel, a top wall 412 and a bottom wall 413 both disposed horizontally and connecting the two opposing sidewalls 411. The first shield member 41 includes a first resilient tab 414 forwardly extending from each of two opposing sidewalls 411 thereof. The two opposing sidewalls 411 each has a clamping slot 415 formed in a front end thereof and in a projecting shape. The bottom wall 413 has a protrusion 416 disposed thereon and convex upwardly, the protrusion 416 has a buckling protrusion 417 arranged thereon. The top wall 412 has a rear shield cover 418 downwardly extending from a rear thereof to wrap a rear of the base 11.

The second shield member 42 covers a peripheral of each of the two mating plates 12, 13. The second shield member 42 includes two opposing sidewalls 421 arranged straight vertically and parallel, and a top wall 422 and a bottom wall 423 both disposed horizontally and connecting the two opposing sidewalls 421. The second shield member 42 has a recess 424 formed on each of two sidewalls 421 thereof and relating to the first resilient tab 414 for containing the first resilient tab 414 into the recess 424. The recess 424 communicates with an opening formed on a rear end thereof. The second shield member 42 has a wing tab 425 folded from a rim around the recess 424, and the wing tab 425 can be folded from an upper portion or a lower portion of the rim around the recess 424.

In the present embodiment, the wing tab 425 is folded from the lower portion of the rim around the recess 424 and arranged horizontally. The wing tab 425 includes an insertion portion 426, which is downwardly or upwardly extended from thereof, connecting on an end thereof. In the present embodiment, the insertion portion 426 is downwardly extended from thereof. The top wall 422 has a clamping tab 427 disposed on an end portion thereof, which the clamping tab 427 relates to and engages with the clamping slot 415 to allow the first shield member 41 and the second shield member 42 to engage with each other. The bottom wall 423 has a projection 428 extending upwardly and connecting the protrusion 416 of the first shield member. The projection 428 has a buckling slot 429 formed thereon, which the buckling slot 429 relates to and engages with the buckling protrusion 417 for the first shield member 41 and the second shield member 42 engaging with each other.

After the engagement of the first shield member 41 and the second shield member 42 in one piece, the first resilient member 414 is just received in the recess 424, and there is a second cavity 43 formed between the inner and outer shield housing 30, 40. The first cavity 36 and the second cavity 43 insert with part of the electrical connector for the mating connector electrically connecting the PCB, and the resilient members 35, 414 clamp the mating connector.

Figure 7:
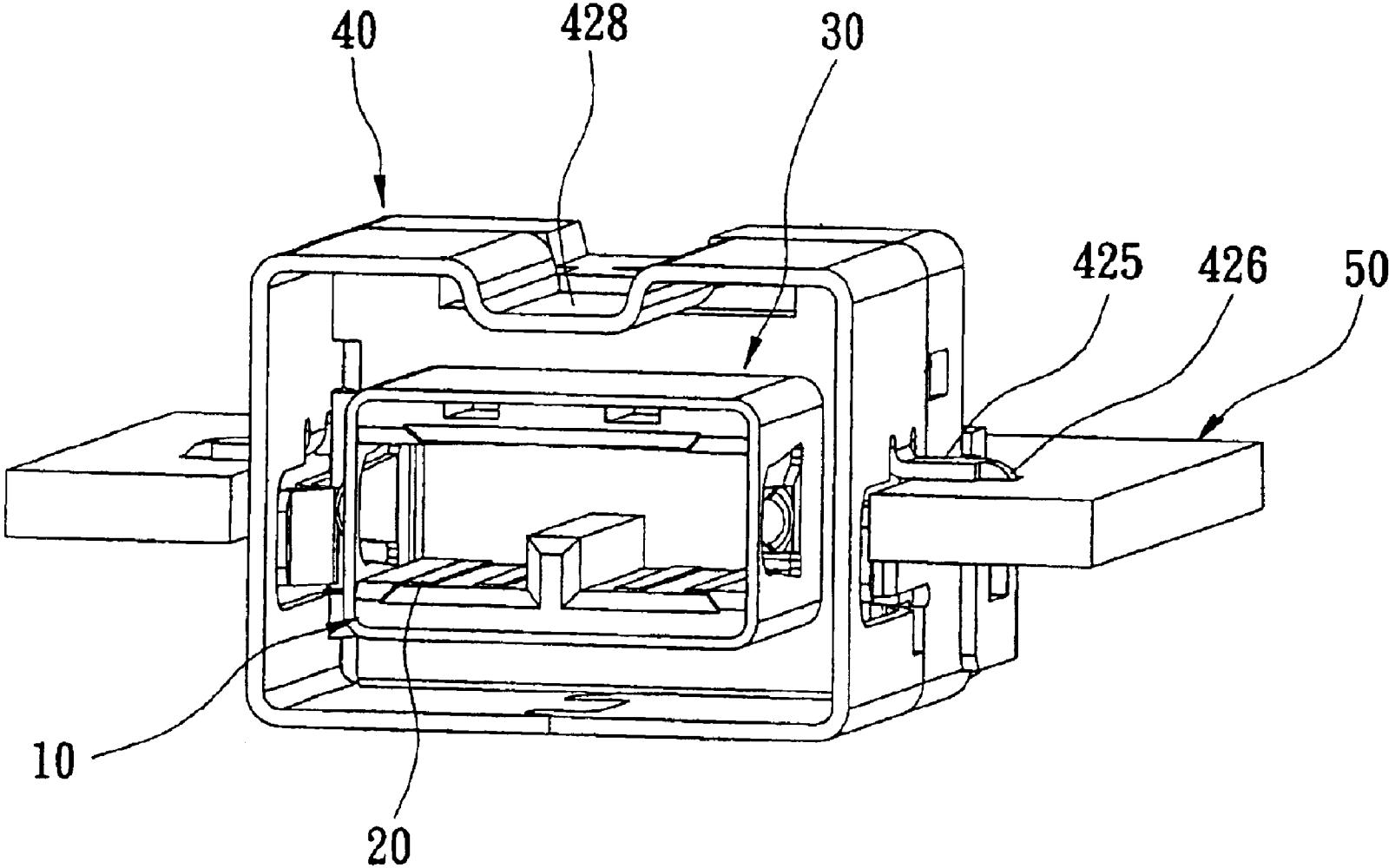
FIG. 7 is a perspective view according to another embodiment of the present invention electrical connector.

With respect to FIG. 3 and FIG. 4, the present invention is capable of being mounted to the PCB 50 in such a manner that a portion of the connector is located above an outer surface 50*a* of the PCB, and another portion of the connector is located below the outer surface 50*a* of the PCB. The PCB 50 has a recess 51 formed thereon for the electrical connector arranged in the recess 51 to reduce the totally height of the electrical connector exposing out of the PCB 50. The wing tabs 425 of the outer shield housing 40 connect the PCB 50 in a SMT (Surface Mounting Technology) manner or insert into corresponding apertures 52 of the PCB 50 to make the electrical connector disposed on the PCB 50 inversely. The electrical connector also can be arranged on the PCB 50 normally in the sinking manner as shown in FIG. 7.

The preferred embodiment discloses the connection ways of the buckling protrusion 417 and the clamping tab 427, which can be applied each or both for the first shield member 41 connecting the second shield member 42, the principal object of the present invention is the two-pieces type of the outer shield housing 40 and not refer to the conjunction thereof.

The preferred embodiment discloses the first resilient tab 414 and the wing tab 425 will not interfere with each other for the wing tab 425 going with the outer shield housing 40, the electrical connector can be disposed on the PCB 50 in a sinking way to reduce the height thereof.

While the disclosed embodiments of the present invention are shown and described, it is envisioned that those skilled in the art may devise various modifications of the present invention without departing from the spirit and scope of the appended claims.

What is claimed is:

1. An electrical connector capable of being applied to a PCB for engaging with a mating connector, the electrical connector comprising:

an insulating housing;

a plurality of electrical terminals within the insulating housing, each of the electrical terminals including a contact portion for electrically engaging with the mating connector and a tail portion extending from the insulating housing for electrically engaging with the PCB;

an inner shield housing including a first cavity formed therein and covering the insulating housing; and an outer shield housing having a first shield member, the first shield member having a top wall and side walls extending from opposing sides of the top wall, a second shield member combining with the first shield member integrally, the second shield member having a top wall and side walls extending from opposing sides of the top wall, the outer shield housing forming a second cavity between the first shield member and the second shield member, wherein the first shield member has a first resilient tab forwardly extending from and connecting with each of two sidewalls thereof, the second shield member has a recess formed on each of two sidewalls thereof and relating to the first resilient tab for containing the first resilient tab into the recess, and a wing tab folded outwardly from a rim around the recess.

2. The electrical connector of claim 1, wherein the PCB includes a recess at an edge thereof, the connector being received within the recess of the PCB in such a manner that the electrical connector includes a portion that is both above an outer surface of the PCB and another portion that is below the outer surface of the PCB.

3. The electrical connector of claim 1, wherein the wing tab is received within an aperture located in the PCB at a location other than the edge of the PCB.

4. The electrical connector of claim 1, wherein the insulating housing includes a base, a first mating plate and a second mating plate parallel arranged and both extending forwardly from the base, electrical terminals being located on both the first mating plate and the second mating plate.

5. The electrical connector of claim 1, wherein the contact portions of the electrical terminals are located on a bottom surface of the first mating plate and a top surface of the second mating plate.

6. The electrical connector of claim 1, wherein the inner shield housing includes two opposing sidewalls arranged straight vertically and parallel, and a top wall and a bottom wall both disposed horizontally and connecting the two opposing sidewalls; the top wall defines a rear wall downwardly extending and connecting a rear end thereof, the two opposing sidewalls each has a second resilient tabs disposed thereon.

7. The electrical connector of claim 1, wherein the first shield member has a clamping slot formed in a front end thereof, the second shield member has a clamping tab disposed on an end portion thereof, which the clamping tab relates to and engages with the clamping slot.

8. The electrical connector of claim 1, wherein the first shield member has a buckling protrusion arranged thereon, the second shield member has a buckling slot formed thereon, which the buckling slot relates to and engages with the buckling protrusion.

9. The electrical connector of claim 1, wherein the wing tab is folded from an upper portion or a lower portion of the rim around the recess.

10. The electrical connector of claim 1, wherein the wing tab has an insertion portion, which is downwardly or upwardly extended from thereof, connecting on an end thereof, the PCB has an insertion aperture relating to the insertion portion of the wing tab and formed thereon for the insertion portion engaging with the insertion aperture.

11. The electrical connector of claim 1, wherein the wing tab connectively solders on the PCB.

* * * * *